US008220269B2

(12) United States Patent
Poyyapakkam

(10) Patent No.: US 8,220,269 B2
(45) Date of Patent: Jul. 17, 2012

(54) COMBUSTOR FOR A GAS TURBINE ENGINE WITH EFFUSION COOLED BAFFLE

(75) Inventor: Madhavan Narasimhan Poyyapakkam, Mellingen (CH)

(73) Assignee: ALSTOM Technology Ltd., Baden (CH)

( * ) Notice: Subject to any disclaimer, the term of this patent is extended or adjusted under 35 U.S.C. 154(b) by 933 days.

(21) Appl. No.: 12/241,199

(22) Filed: Sep. 30, 2008

(65) Prior Publication Data

US 2010/0077757 A1 Apr. 1, 2010

(51) Int. Cl.
*F02C 1/00* (2006.01)
*F02G 3/00* (2006.01)

(52) U.S. Cl. ..... 60/737; 60/733; 60/752; 60/738; 60/754

(58) Field of Classification Search ..... 60/733, 60/737, 752–760, 740, 804, 742, 746, 747, 60/748, 738, 749, 750
See application file for complete search history.

(56) References Cited

U.S. PATENT DOCUMENTS

| | | | | |
|---|---|---|---|---|
| 1,866,311 | A | 7/1932 | Leiman | |
| 2,701,164 | A | 2/1955 | Orent et al. | |
| 3,510,064 | A | 5/1970 | Read et al. | |
| 3,648,457 | A * | 3/1972 | Bobo | 60/737 |
| 4,133,485 | A | 1/1979 | Bouvin | |
| 4,258,544 | A | 3/1981 | Gebhart et al. | |
| 4,457,241 | A | 7/1984 | Itse et al. | |
| 4,603,548 | A * | 8/1986 | Ishibashi et al. | 60/773 |
| 4,952,136 | A | 8/1990 | Collins et al. | |
| 4,982,570 | A * | 1/1991 | Waslo et al. | 60/733 |
| 5,054,280 | A * | 10/1991 | Ishibashi et al. | 60/776 |
| 5,129,333 | A | 7/1992 | Frederick et al. | |
| 5,201,181 | A * | 4/1993 | Ohmori et al. | 60/737 |
| 5,216,885 | A * | 6/1993 | Taniguchi et al. | 60/737 |
| 5,393,220 | A | 2/1995 | Couwels et al. | |
| 5,405,082 | A | 4/1995 | Brown et al. | |
| 5,465,570 | A * | 11/1995 | Szillat et al. | 60/776 |
| 5,490,380 | A * | 2/1996 | Marshall | 60/776 |
| 5,617,718 | A | 4/1997 | Althaus | |
| 5,687,571 | A * | 11/1997 | Althaus et al. | 60/737 |
| 5,701,732 | A | 12/1997 | Nesbitt et al. | |
| 5,749,219 | A * | 5/1998 | DuBell | 60/804 |
| 5,836,164 | A * | 11/1998 | Tsukahara et al. | 60/733 |
| 6,027,331 | A * | 2/2000 | Dobbeling et al. | 431/182 |
| 6,055,813 | A * | 5/2000 | Keller et al. | 60/759 |

(Continued)

OTHER PUBLICATIONS

Non-Final Office Action from U.S. Appl. No. 12/241,211 (Feb. 18, 2011).

(Continued)

*Primary Examiner* — William H Rodriguez
(74) *Attorney, Agent, or Firm* — Cermak Nakajima LLP; Adam J. Cermak

(57) ABSTRACT

A combustor (1) for a gas turbine engine, particularly for a gas turbine having sequential combustion, includes a combustor wall (4) defining a mixing region (5) and a combustion region (6). The mixing region (5) has at least one first inlet (2) for introducing combustion air into the mixing region (5) and at least one second inlet for introducing fuel into the mixing region (5), the combustion region (6) extending downstream of the mixing region. The mixing region (5) crosses over to the combustion region (6) in a transition region (14). A baffle (9) extends from the transition region (14) generally in the downstream direction (15), forming at least one space (10) between the combustor wall (4) and the baffle (9).

9 Claims, 2 Drawing Sheets

U.S. PATENT DOCUMENTS

| | | | | |
|---|---|---|---|---|
| 6,076,356 | A | 6/2000 | Pelletier | |
| 6,089,024 | A * | 7/2000 | Hatanaka | 60/671 |
| 6,098,407 | A | 8/2000 | Korzendorfer et al. | |
| 6,174,161 | B1 | 1/2001 | Slavejkov et al. | |
| 6,202,399 | B1 | 3/2001 | Frutschi | |
| 6,270,338 | B1 * | 8/2001 | Eroglu et al. | 431/8 |
| 6,339,923 | B1 | 1/2002 | Halila et al. | |
| 6,349,886 | B1 | 2/2002 | Bouti | |
| 6,351,947 | B1 * | 3/2002 | Keller et al. | 60/725 |
| 6,431,467 | B1 | 8/2002 | Joshi et al. | |
| 6,460,344 | B1 * | 10/2002 | Steinthorsson et al. | 60/776 |
| 6,539,724 | B2 | 4/2003 | Cornwell et al. | |
| 6,581,386 | B2 * | 6/2003 | Young et al. | 60/748 |
| 6,622,488 | B2 | 9/2003 | Mansour et al. | |
| 6,679,061 | B2 * | 1/2004 | Steinbach et al. | 60/777 |
| 6,832,482 | B2 * | 12/2004 | Martling et al. | 60/737 |
| 6,871,503 | B1 * | 3/2005 | Inoue et al. | 60/776 |
| 6,978,622 | B2 | 12/2005 | Dittmann et al. | |
| 6,981,358 | B2 * | 1/2006 | Bellucci et al. | 60/39.17 |
| 7,082,770 | B2 * | 8/2006 | Martling et al. | 60/796 |
| 7,140,183 | B2 * | 11/2006 | Ruck et al. | 60/737 |
| 7,155,913 | B2 * | 1/2007 | Beule et al. | 60/804 |
| 7,174,717 | B2 | 2/2007 | Prociw | |
| 7,185,497 | B2 * | 3/2007 | Dudebout et al. | 60/776 |
| 7,416,404 | B2 | 8/2008 | Chan | |
| 7,426,833 | B2 * | 9/2008 | Yoshida et al. | 60/737 |
| 7,454,914 | B2 | 11/2008 | Prociw | |
| 7,503,178 | B2 | 3/2009 | Bucker et al. | |
| 7,568,335 | B2 | 8/2009 | Althaus | |
| 7,568,345 | B2 | 8/2009 | Furletov et al. | |
| 7,762,070 | B2 | 7/2010 | Dawson et al. | |
| 7,908,842 | B2 | 3/2011 | Eroglu et al. | |
| 7,934,381 | B2 | 5/2011 | Eroglu et al. | |
| 7,950,239 | B2 | 5/2011 | Lilley et al. | |
| 7,992,808 | B2 | 8/2011 | Micheli | |
| 8,015,815 | B2 | 9/2011 | Pelletier et al. | |
| 8,020,384 | B2 | 9/2011 | Pelletier et al. | |
| 2006/0005542 | A1 | 1/2006 | Campbell et al. | |
| 2007/0107437 | A1 * | 5/2007 | Evulet et al. | 60/776 |
| 2007/0227155 | A1 | 10/2007 | Nemet et al. | |
| 2009/0211257 | A1 * | 8/2009 | Cankovic et al. | 60/740 |
| 2009/0293482 | A1 | 12/2009 | Davis et al. | |
| 2010/0071374 | A1 | 3/2010 | Fox et al. | |
| 2010/0077720 | A1 | 4/2010 | Poyyapakkam | |
| 2010/0077756 | A1 | 4/2010 | Poyyapakkam | |
| 2010/0205970 | A1 | 8/2010 | Hessler et al. | |

OTHER PUBLICATIONS

Office Action from co-pending U.S. Appl. No. 12/241,223 (Nov. 28, 2011).

Office Action from co-pending U.S. Appl. No. 12/241,211 (Sep. 22, 2011).

* cited by examiner

COMBUSTOR FOR A GAS TURBINE ENGINE WITH EFFUSION COOLED BAFFLE

BACKGROUND

1. Field of Endeavor

The present invention relates to a combustor for a gas turbine, particularly for a gas turbine having sequential combustion.

2. Brief Description of the Related Art

A gas turbine with sequential combustion is known to improve the efficiency of a gas turbine. This is achieved by increasing the turbine inlet temperature. In a sequential combustion gas turbine engine, fuel is burnt in a first combustor and the hot combustion gases are passed through a first turbine and subsequently supplied to a secondary combustor into which additional fuel is introduced. The combustion of the hot gases and the fuel is completed in the secondary combustor and the exhaust gases are subsequently supplied to the low pressure turbine. The secondary combustor has a mixing region where fuel is introduced and mixed with the combustion gases, and a downstream combustion region. The two regions are defined by a combustor wall having a combustion front panel positioned generally between the mixing and combustion regions.

The secondary combustor is known in the art as an SEV (Sequential EnVironmental) combustor and the first combustor is known as EV (EnVironmental) or AEV (Advanced EnVironmental) combustor. Partly due to the introduction of hydrogen ($H_2$) rich syngas fuels, which have higher flame speeds and temperatures, there is a requirement to reduce emissions, particularly of NOx, which are produced under these conditions.

SUMMARY

One of numerous aspects of the present invention involves a novel way to reduce NOx emissions, by providing a combustor for a gas turbine engine, particularly for a gas turbine having sequential combustion, with a reduced flame temperature, thereby permitting reducing levels of NOx emissions.

Another aspect of the present invention relates to a combustor for a gas turbine engine, particularly for a gas turbine having sequential combustion, having a combustor wall defining a mixing region and a combustion region, in which the mixing region has at least one first inlet for introducing combustion air into the mixing region and at least one second inlet for introducing fuel into the mixing region, The combustion region extends downstream of the mixing region, and the mixing region crosses over to the combustion region in a transition region.

A baffle extends from the transition region generally in the downstream direction forming at least one space between the combustor liner wall and the baffle.

It has been found that providing a baffle in this area has the effect of splitting the classical SEV or EV flame into two less intense or low heat release flames. The peak temperatures of these flames in this staged combustion is significantly reduced compared to the peak temperatures encountered in a single flame as seen in conventional combustors, therefore the production of NOx is also significantly reduced. In addition to reduced emissions, the thermoacoustic oscillations due to heat release fluctuations are reduced due to distributed heat release.

In a further preferred embodiment adhering to principles of the present invention, the baffle extends generally in the flow direction from a combustion front panel and the baffle is cooled by a cooling fluid or cooling air. The cooling provided to the baffle improves the cooling of the flame contributing to further reduction in NOx.

In another exemplary embodiment, the amount of fuel and air flow rates through the mixing regions can be varied to obtain the desired flame characteristics.

The above and other aspects, features, and advantages of the invention will become more apparent from the following description of certain preferred embodiments thereof, when taken in conjunction with the accompanying drawings.

BRIEF DESCRIPTION OF THE DRAWINGS

The invention is described referring to an embodiment depicted schematically in the drawings, and will be described with reference to the drawings in more details in the following.

The drawings show schematically in.

DETAILED DESCRIPTION OF EXEMPLARY EMBODIMENTS

Figure 2:
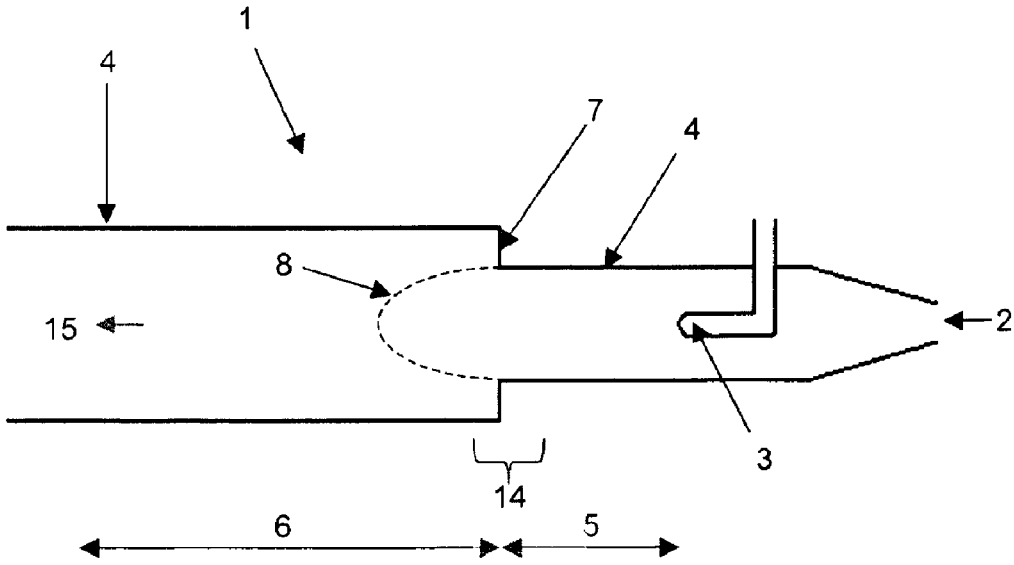
Fig. 2 (Prior Art)
FIG. 2 a prior art combustor for a sequential combustion gas turbine engine, and FIG. 3 a combustor according to a second embodiment of the invention.

FIG. 2 schematically illustrates a combustor 1 for use in a sequentially operated gas turbine arrangement according to the state of the art.

The combustor 1 shown in FIG. 2 is an SEV (Sequential EnVironmental) combustor. A first inlet 2 is provided at the upstream end of the combustor 1 for introducing the hot gases from the first combustor (not shown) into the SEV combustor 1. These hot gases contain sufficient oxidizer for further combustion in the SEV combustor 1. A second inlet 3 arranged in a lance is provided downstream of the first inlet for introducing fuel into the SEV combustor 1. The wall 4 of the combustor 1 defines a region 5 for mixing the fuel with the hot gases and a combustion region 6. The mixing region 5 crosses over to the combustion region 6 in a transition region 14. The cross sectional area of the mixing region 5 is smaller than the cross sectional area of the combustion region 6. A combustor front panel 7 is arranged in a region between the mixing region 5 and the combustion region 6. The characteristics of combustion in such a combustor are largely determined by the amount of mixing of the fuel with the combustion gas in the mixing region 5. Higher levels of fuel/air mixing induce thermoacoustic pulsations, where as lower levels of mixing results in formation of NOx. There are therefore conflicting aero/thermal goals, whereby it is difficult to achieve one without detriment to the other. The dotted line 8 represents the general shape of the flame in the conventional combustor 1. It can be seen that the flame front develops in the region of the combustor front panel 7 and extends a certain distance into the combustion region 6. The area of the high temperature part of the flame is relatively large which leads to high levels of NOx production.

Figure 1:
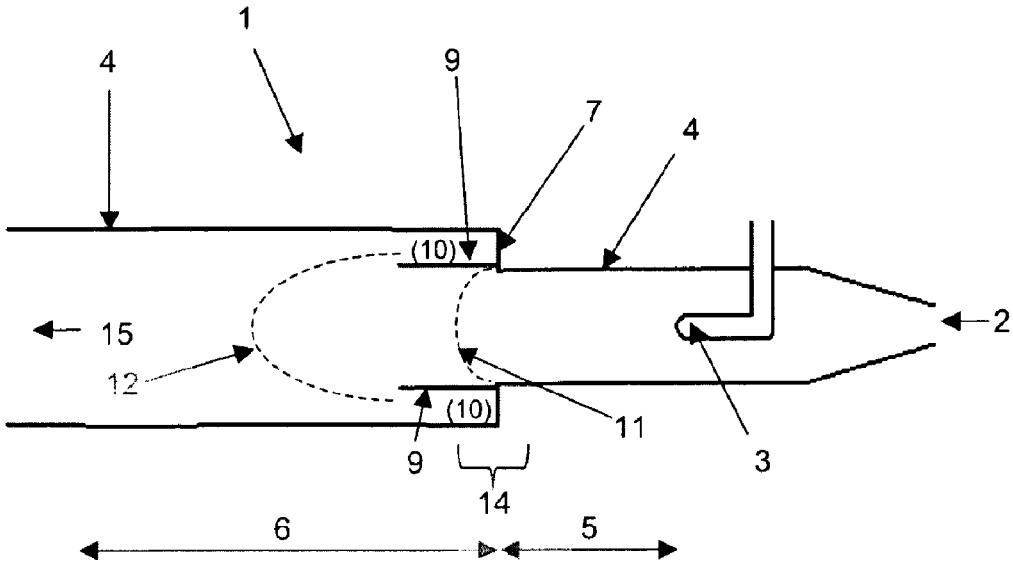
FIG. 1 a combustor according to one embodiment of the invention.

Now referring to FIG. 1, which schematically illustrates a combustor 1 according to a preferred embodiment of the invention, the same features as in FIG. 2 are designated with the same reference numerals. The combustor 1 may be for use in a sequentially operated gas turbine arrangement. A baffle 9 extends from the transition region 14 generally in the downstream direction 15 forming at least one space 10 between the combustor wall 4 and the baffle 9. The baffle extends preferably from the wall 4 of the combustor 1. The space 10 is only exposed to the main gas flow through the combustor at its downstream end. It has been found that providing a baffle 9 in this area has the effect of splitting the classical flame into two less intense flames denoted by the dotted lines 11 and 12. The first flame 11 develops from the area of the combustion front panel and the second flame develops from the area at the end of the baffle 9. As can be seen from the figure, the size of the first flame 11 is reduced compared to the single conventional flame 8 and the size of the flame 12 is larger than the size of the conventional flame 8. The high temperature area of these flames 11, 12 in this staged combustion is significantly reduced compared to the high temperature area of the single flame 8 in conventional combustors, therefore the production of NOx is also significantly reduced. Introducing the baffle 9 into the combustor in the position shown in FIG. 1 has been found to cool the hottest part of the flame and distribute the heat to the less hot parts of the flame thereby creating a more even temperature distribution throughout the flame, which is beneficial to reducing emissions. The turbine inlet temperature, which is critical in determining the power of the turbine, remains the same.

The baffle 9 is shown extending parallel with the centre axis of the combustor 1. It can however also extend at an angle to the centerline of the combustor 1, or it may have a curved form. The baffle 9 extends preferably from the combustion front panel 7. The length of baffle 9 in the axial direction is chosen such that a secondary flame 12 can be created during combustion or such that sufficient cooling of the flame takes place.

Cooling air or air from the combustion gases of a first combustor in a sequential combustion system is preferably introduced into the space between the combustor wall 4 and the baffle 9. The cooling air can be introduced through the combustor front panel 7 or it can be introduced through a passage in the baffle 9. Alternatively the baffle can be effusion cooled whereby a plurality of small holes is provided in the baffle 9. The baffle 9 is cooled so that it has itself a cooling effect on the flame, which helps in reducing peak temperatures and NOx emissions.

Figure 3:
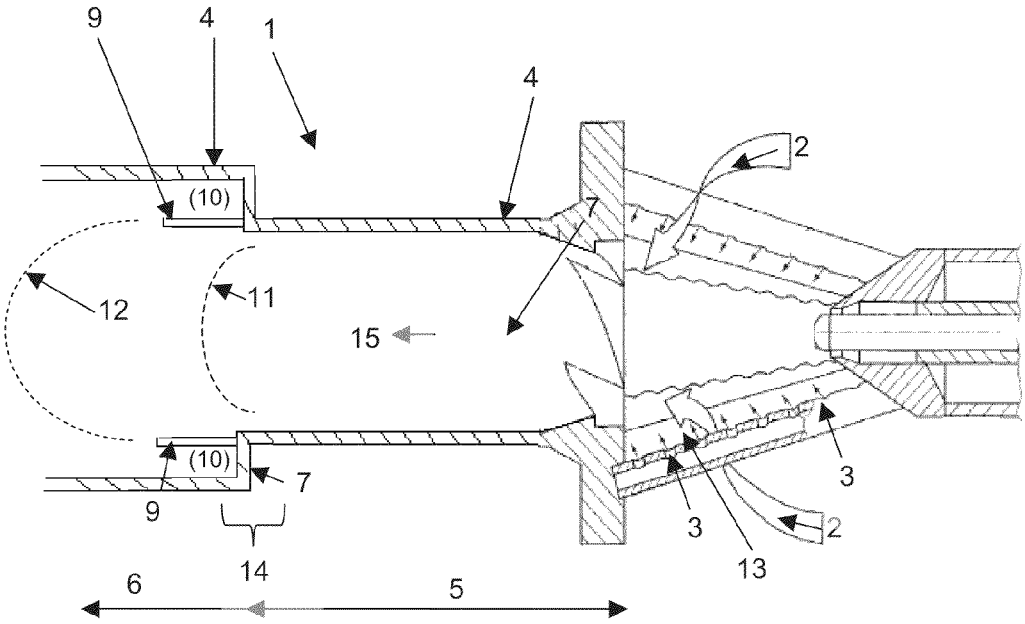

Principles of the invention can also be applied to an AEV (Advanced EnVironmental) combustor as shown schematically in FIG. 3. In an AEV combustor, the oxidization air inlet 2 is formed by axial slots in the wall 4 of the combustor 1. The fuel is also injected through a plurality of holes in the wall 4 of the combustor 1.

Due to the introduction of the baffles 9, the emissions of NOx can be reduced. Therefore less stringent procedures can be adopted for controlling the fuel air mixing in the mixing region 5.

The preceding description of the embodiments according to the present invention serves only an illustrative purpose and should not be considered to limit the scope of the invention.

Particularly, in view of the preferred embodiments, different changes and modifications in the form and details can be made without departing from the scope of the invention. Accordingly the disclosure should not be limiting. The disclosure herein should instead serve to clarify the scope of the invention which is set forth in the following claims.

LIST OF REFERENCE NUMERALS

1. Combustor
2. First inlet
3. Second inlet
4. Combustor wall
5. Mixing region
6. Combustion region
7. Combustion front panel
8. Dotted line
9. Baffle
10. Space
11. First flame
12. Second flame
13. Slot(s)
14. Transition region
15. Flowdirection While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. A combustor for a gas turbine engine, comprising:

a combustor wall defining a mixing region and a combustion region, the mixing region comprising at least one first inlet for introducing combustion air into the mixing region and at least one second inlet for introducing fuel into the mixing region, the combustion region extending downstream of the mixing region, the mixing region crossing over to the combustion region in a transition region; and a baffle extending from the transition region generally in the downstream direction, forming at least one space between the combustor wall and the baffle, the baffle comprising holes for effusion cooling of the baffle with air or combustion gas.

2. The combustor according to claim 1, wherein the cross sectional area of the combustor increases between the mixing region and the combustion region.

3. The combustor according to claim 2, further comprising:

a combustion front panel; and wherein the baffle extends generally in the flow direction from the combustion front panel.

4. The combustor according to claim 1, further comprising:

a cooling fluid in the space between the combustor wall and the baffle.

5. The combustor according to claim 1, further comprising cooling air or exhaust gas in the baffle.

6. The combustor according to claim 1, wherein the axial length of baffle is such that a secondary flame can be created during combustion.

7. The combustor according to claim 1, wherein the combustor is an SEV combustor and comprises a fuel lance which projects into the combustor, and wherein the at least one second inlet for introducing fuel into the combustor is located on the fuel lance.

8. The combustor according to claim 1, wherein the combustor is an AEV combustor having through slots or holes in the walls of the combustor, and wherein the at least one first inlet and the at least one second inlet comprise said slots or holes.

9. A sequentially operated gas turbine comprising a combustor according to claim 1.

* * * * *